US006428195B1

(12) United States Patent
Ohshio et al.

(10) Patent No.: US 6,428,195 B1
(45) Date of Patent: Aug. 6, 2002

(54) VEHICLE HEADLAMP WITH MOVABLE AND FIXED SHADES

(75) Inventors: Hirohiko Ohshio; Michio Tsukamoto, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/691,712

(22) Filed: Oct. 18, 2000

(30) Foreign Application Priority Data

Oct. 19, 1999 (JP) ..... 11-297483

(51) Int. Cl.[7] ..... F21V 17/02

(52) U.S. Cl. ..... 362/512; 362/513; 362/284; 362/324

(58) Field of Search ..... 362/512, 513, 362/282, 284, 322, 324

(56) References Cited

U.S. PATENT DOCUMENTS

| | | | | |
|---|---|---|---|---|
| 4,987,521 A | | 1/1991 | Fratty et al. | |
| 5,213,406 A | | 5/1993 | Neumann et al. | |
| 5,412,543 A | * | 5/1995 | Kobayashi et al. | 362/564 |
| 5,899,559 A | | 5/1999 | Lachmayer et al. | 362/513 |
| 6,286,985 B1 | * | 9/2001 | Ohshio et al. | 362/512 |

FOREIGN PATENT DOCUMENTS

| | | | |
|---|---|---|---|
| GB | 2332742 A | 6/1999 | B60Q/1/076 |
| GB | 2341672 A | 3/2000 | B60Q/1/14 |
| GB | 2341673 A | 3/2000 | B60Q/1/14 |

* cited by examiner

*Primary Examiner*—Sandra O'Shea
*Assistant Examiner*—Ronald E. DelGizzi
(74) *Attorney, Agent, or Firm*—Fish & Richardson, P.C.

(57) ABSTRACT

A vehicle headlamp is equipped with a shade driving unit 24 for moving a movable shade 22, which is capable of shading part of light incident on a reflector 20 from the discharge light emitting portion 18*a* of a discharge bulb 18, between at least two positions where the incident light is shed in different degrees. The discharge bulb 18 is fixedly supported by the reflector 30 via a bulb supporting base 26 and the movable shade 22 and the shade driving unit 24 are fitted to the bulb supporting base 26. Thus, the light source bulb 18, the movable shade 22 and the shade driving unit 24 together with the bulb supporting base 26 can be operated integrally as a unit. The unit is prefabricated before being fitted to the reflector 20 to facilitate the assembling of the lamp. Moreover, the precision of placement of the movable shade 22 with respect to the discharge light emitting portion 18*a* can also be improved.

20 Claims, 5 Drawing Sheets

VEHICLE HEADLAMP WITH MOVABLE AND FIXED SHADES

FIELD OF THE INVENTION

The present invention relates to a vehicle headlamp arranged to vary the light distribution of a headlamp by moving a movable shade.

BACKGROUND OF THE INVENTION

Vehicle headlamps are arranged to emit low or high beams by causing reflectors to reflect light from light sources forward. However, because the light distribution patterns differ between low and high beams, it is common to use a light source bulb having two light sources or two light source bulbs for the purpose of switching between low and high beams.

There exists a vehicle headlamp using a single light source for switching beams, particularly, a two-lamp type headlamp using a discharge bulb as a light source bulb.

One known method for switching beams using a single light source switches beams by moving a movable shade. The movable shade is made movable by a shade driving unit between two positions where an incident light from a light source to a reflector is shaded differently.

In the aforementioned vehicle headlamp having the shade driving unit, the movable shade is movably fitted to the reflector, and the shade driving unit is fitted to the reflector before being coupled to the movable shade. Consequently, the headlamp is not assembled efficiently nor the precision of placement of the movable shade with respect to the light source readily improved.

The problem of this kind generally arises from not only switching beams from low to high by moving the movable shade but also varying light distribution of the lamp thereby.

An object of the present invention is to provide a vehicle headlamp which is designed to vary its light distribution by moving a movable shade, and which is capable of improving not only lamp assembly efficiency but also the precision of placement of the movable shade with respect to a light source.

SUMMARY OF THE INVENTION

The present invention is intended to accomplish the object above by employing a predetermined bulb supporting base.

A vehicle headlamp according to the invention comprises a light source, a reflector for reflecting light from the light source forward, a movable shade capable of shading part of light incident on the reflector from the light source, and a shade driving unit for moving the movable shade between at least two positions where an incident light shading quantity has different values.

A light source bulb as the light source is fixedly supported by the reflector via a bulb supporting base for fixedly supporting the light source bulb, and the movable shade and the shade driving unit are fitted to the bulb supporting base.

The above "light source" is not limited to a specific kind but maybe any discharge light emitting bulb portion, for example, an incandescent bulb filament of, for example, a halogen bulb.

The "movable shade" may be of any kind capable of shading part of light incident on the reflector from the light source bulb and not limited to a specific configuration.

"At least two positions where an incident light shading quantity has different values" may be more than two positions including or not including positions where a low- or high-beam light distribution pattern may be formed when the movable shade is located at one of the above positions.

The "shade driving unit" is not limited to a specific driving unit but may be any one so designed as to move the movable shade between at least two positions For example, the shade driving unit may comprise a solenoid, a pulse motor or the like. Further, the "moving behavior" of the movable shade by use of the shade driving unit is not restrictive but may be pivotal, linearly reciprocal or the like.

The "bulb supporting base" is not limited to a special sort but may be so configured that the light source bulb is fixedly supported by the reflector while the movable shade and the shade driving unit are installed.

The vehicle headlamp according to the invention is equipped with the shade driving unit for moving the movable shade, which is capable of shading part of light incident on the reflector from the light source, between at least two positions where an incident light is shaded differently. However, as the light source bulb having the light source is fixedly supported by the reflector via the bulb supporting base, the light source bulb, the movable shade and the shade driving unit together with the bulb supporting base can be operated integrally as a unit. Thereof, the unit is prefabricated before being fitted to the reflector so as to facilitate the assembling of the lamp. Moreover, the precision of placement of the movable shade with respect to the light source can also be improved.

In the vehicle headlamp configured to vary the light distribution of the lamp by moving the movable shade according to the invention, it is possible to improve not only lamp assembly efficiency but also the precision of placement of the movable shade with respect to a light source.

Although the bulb supporting base is not limited to a special sort as mentioned above, the precision of placement of the movable shade with respect to the light source is improved further by die-casting the movable shade that has excellent dimensional precision and strength.

In the aforementioned arrangement, the fixed shade for covering the movable shade substantially in front of the movable shade makes it difficult for the movable shade and its peripheral structure to be seen from the outside. In addition, the work of assembling the lamp can be facilitated by fixedly supporting the fixed shade with the bulb supporting base.

In the aforementioned arrangement, part of the reflector may be formed separately from the remaining portion of the reflector and that part of the reflector maybe formed integrally with the bulb supporting base, so that the bulb supporting base can be fixedly supported by utilizing a wider area with respect to the remaining portion of the reflector. Thus, the precision of placement of the optical system of the lamp can be increased.

DETAILED DESCRIPTION OF THE INVENTION

An embodiment of the present invention will now be described with reference to the drawings.

Figure 1:
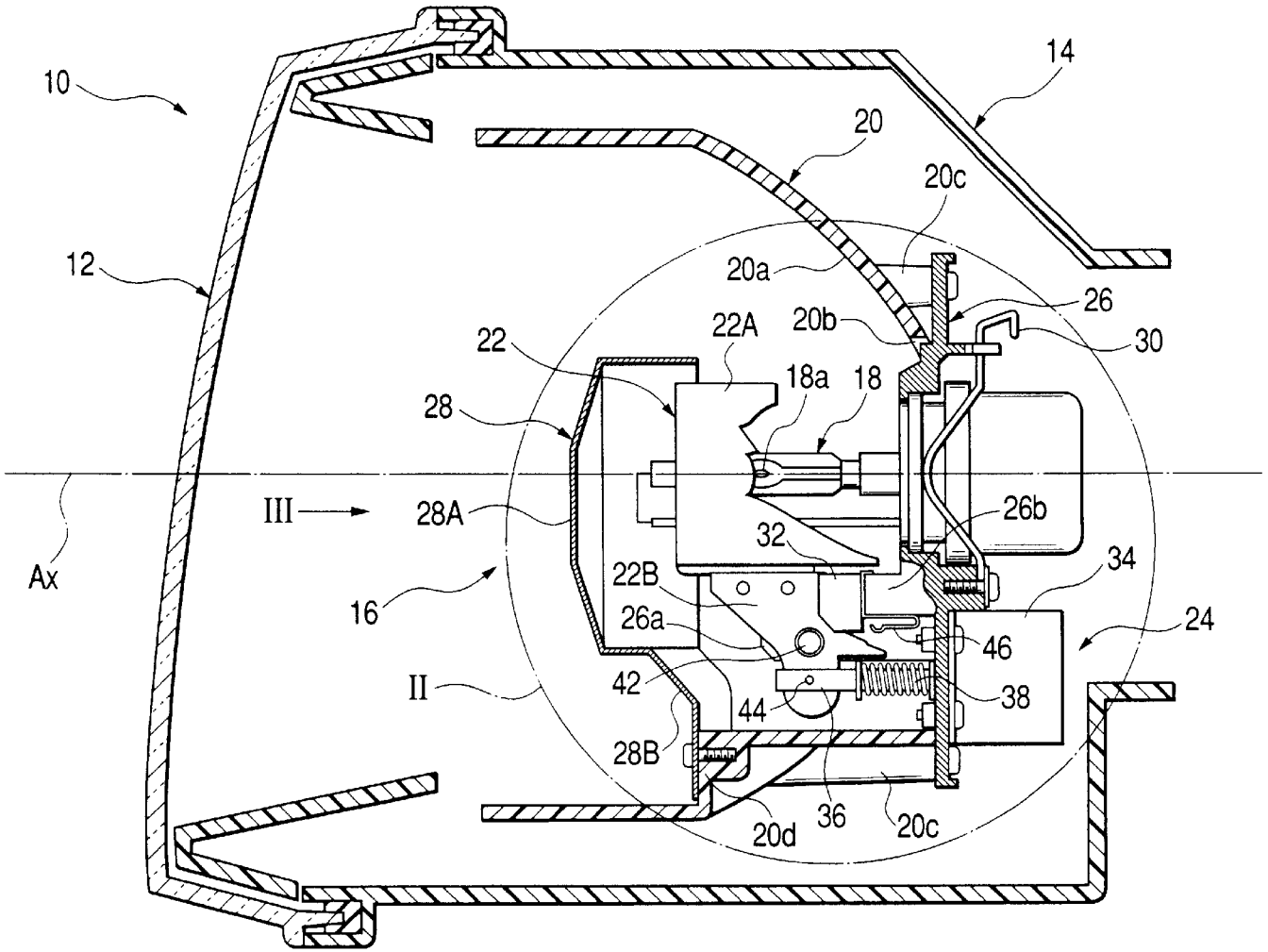
FIG. 1 is a sectional side view of a vehicle headlamp according to an embodiment of the invention.
Figure 2B:
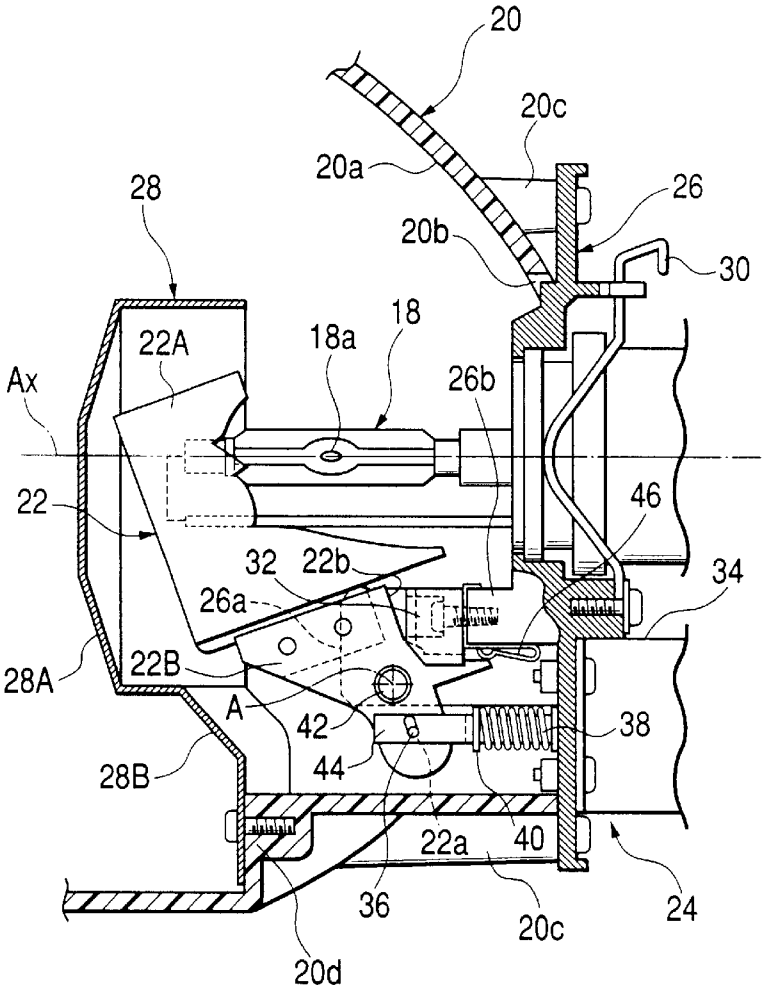
FIG. 2 is a detailed sectional side view of a region II of FIG. 1.
Figure 2A:
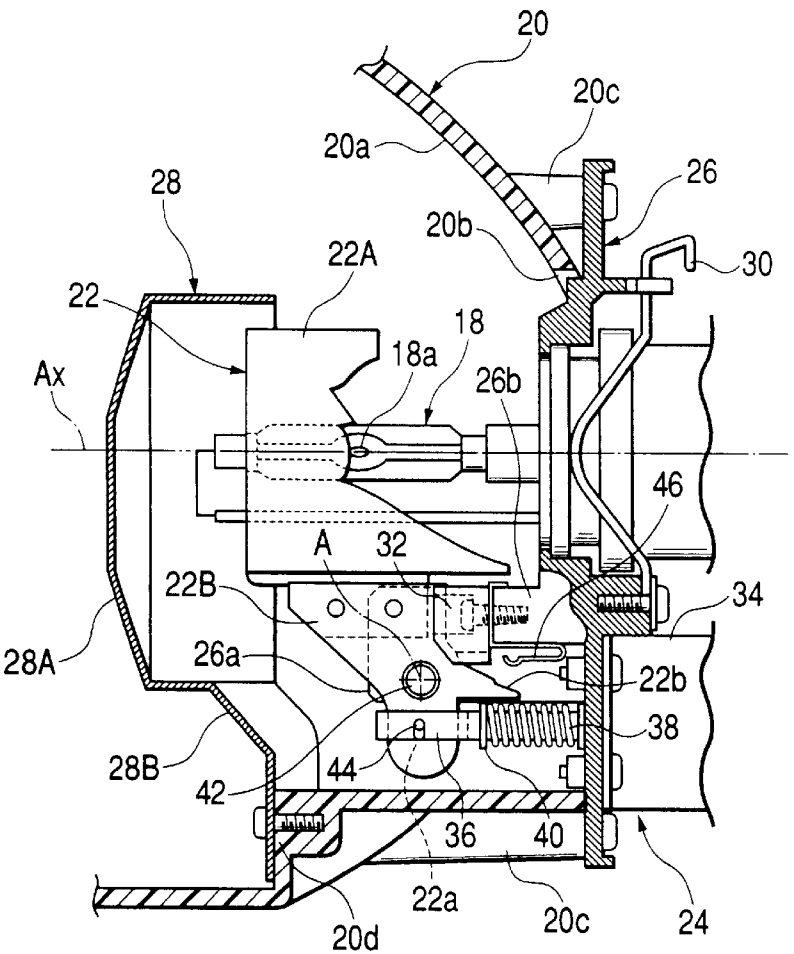
Figure 3:
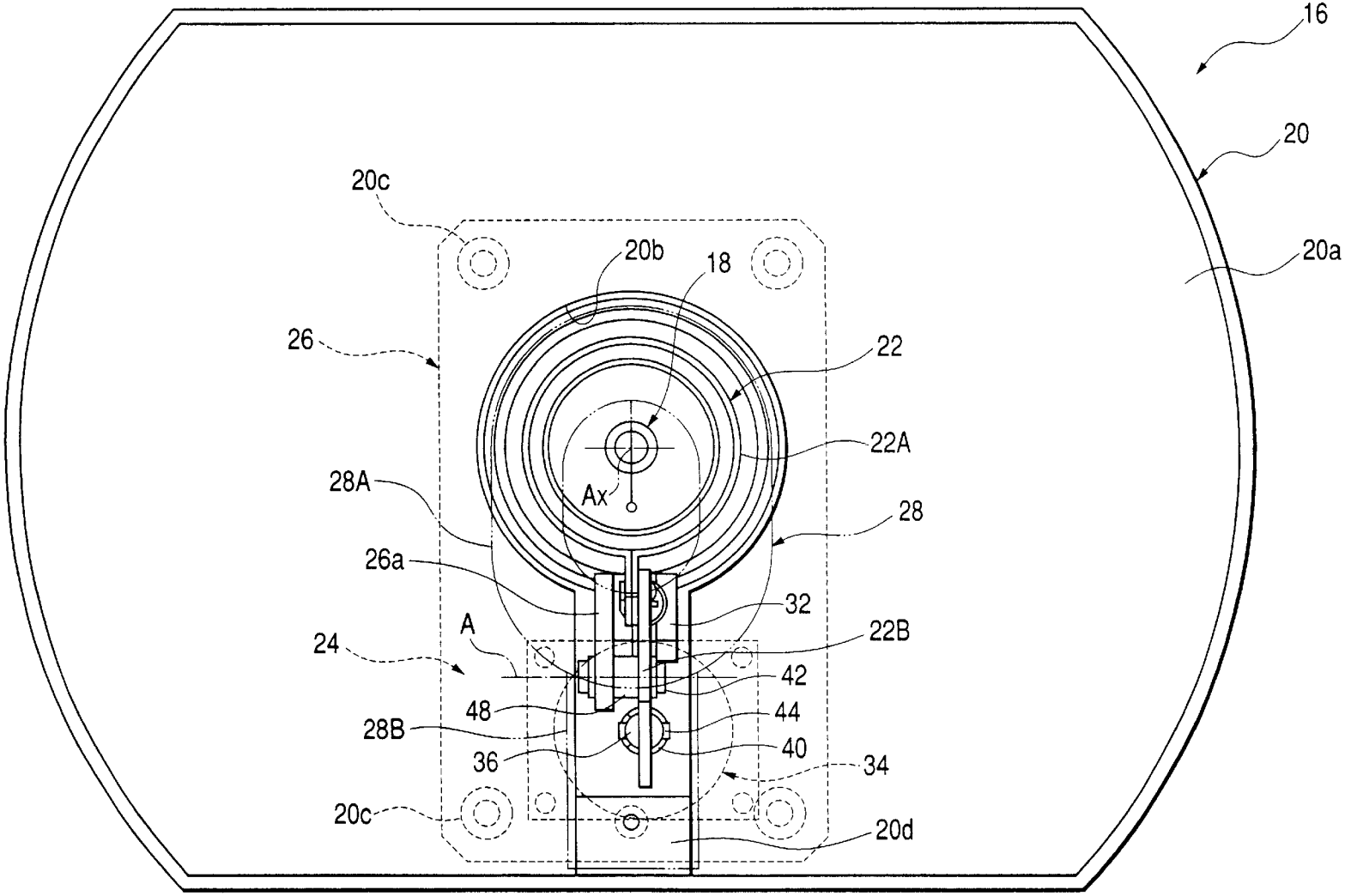
FIG. 3 is a sectional view taken on line III—III of FIG. 1.

FIG. 1 is a sectional side view of a vehicle headlamp according to an embodiment of the invention. FIG. 2 is a detail view of the II portion of FIG. 1. FIG. 3 is a sectional view taken on line III of FIG. 1.

As shown in FIG. 1, a vehicle headlamp 10 according to this embodiment of the invention is such that a reflector unit 16 is set tiltable vertically and horizontally via an aiming mechanism within a lamp chamber formed with a lens 12 and the lamp body 14.

The reflector unit 16 is provided with a discharge bulb (metal halide bulb) 18, a reflector 20, a movable shade 22, a shade driving unit 24, a bulb supporting base 26, and a fixed shade 28.

The lens 12 is a plain-glass lens, and a light distribution control function is given to the reflector unit 16. More specifically, the reflector 20 has a reflective surface 20*a* for reflecting light forward from the discharge light emitting portion (light source) of the discharge bulb 18 in order to emit beams for use in forming a predetermined light distribution pattern with the diffusion or deflection reflective function of the reflective surface 20*a*.

The discharge bulb 18 is fixedly supported by the reflector 20 via a bulb supporting base 26. That is, the bulb supporting base 26 is made by die casting and fixed to a plurality of bosses 20*c* with screws on the back of the reflector 20 in such a way that the bulb supporting base 26 is inserted into the opening portion 20*b* in the rear top of the reflector 20 from the back. The discharge bulb 18 is fixedly supported with the bulb supporting base 26 by a wire spring 30. At this time, the discharge light emitting portion 18*a* of the discharge bulb 18 is placed on the optical axis Ax of the reflector 20.

The movable shade 22 is formed with a cylindrical shade body 22A whose rear end edge has a complicated rugged shape, and with a plate-like stay 22B extending from the lower end portion of the shade body 22A downward and slightly rearward. These shade body and the stay are riveted together.

The movable shade 22 is allowed by the shade driving unit 24 to take a low-beam position as shown in FIG. 2(*a*) and a high-beam position as shown in FIG. 2(*b*). Further, the movable shade 22 uses the shade body 22A to shade part of light incident on the reflective surface 20*a* of the reflector 20 from the discharge light emitting portion 18*a* of the discharge bulb 18 in the low-beam position to produce light necessary for emitting a low beam incident on the reflective surface 20*a*. In the high-beam position, the movable shade 22 operates to secure a quantity of light necessary for high-beam irradiation by reducing the shading of light incident on the reflective surface 20*a* because of the shade body 22A.

The shade driving unit 24 includes a solenoid 34 fixedly screwed to the bulb supporting base 26 under the optical axis Ax of the reflector 20, and a return spring 38 fitted to a movable iron core 36 of the solenoid 34 and used to urge the movable iron core 36 toward an unexcited position.

The movable iron core 36 is equipped with an E-ring 40 in its intermediate portion for stopping the elastic urging force of the return spring 38 by abutting against the front end portion of the return spring 38, its front end portion being laterally forked.

The movable shade 22 is pivotally supported around a pivotal axis A laterally extending via a shaft member 42 formed in such a way as to protrude forward from the bulb supporting base 26 in the intermediate portion of its stay 22B. In this case, an annular spacer 48 is installed between the stay 22B and a support bracket 26*a*, so that the looseness of the coupling portion between the stay 22B and the shaft member 42 is minimized.

The movable shade 22 is coupled to the front end portion of the movable iron core 36 via a pin 44 in the lower end portion of the stay 22B in such a way that while the front end portion of the stay 22B is laterally clamped with the forked front end portion of the movable iron core 36, the movable shade 22 is fixed to the front end portion by laterally passing the pin 44 therethrough. A slit 22*a* for receiving the pin 44 is formed in the front end portion of the stay 22B so as to extend vertically. Thus, the variation in the distance between the shaft member 42 and the pin 44 is absorbed as the movable shade 22 pivots.

A projected portion 26*b* projecting forward is formed in a region close to the base portion of the support bracket 26*a* on the bulb supporting base 26. A displacement regulating block 32 is fixed to the projected portion 26*b* with a screw from front via a displacement regulating spring 46. This displacement regulating block 32 is made from a (e.g., fluorine) plastic member that hardly produces a knocking sound, and a V-shaped groove is formed from the front end face up to the lower end face.

Switching beams from low to high by means of the shade driving unit 24 is carried out as described below.

When the beam changeover switch (not shown) of the shade driving unit 24 is turned off, the movable iron core 36 is moved forward by the elastic urging force of the return spring 38. The movable iron core 36 of the solenoid 34 is in the unexcited state. Consequently, the stay 22B of the movable shade 22 is pivoted backward around the pivotal axis A up to the position where the stay 22B butts against the front end face of the displacement regulating block 32 and fixed to the low-beam position shown in FIG. 2(*a*). When the movable iron core 36 of the solenoid 34 is excited with the beam changeover switch being turned on, the stay 22B of the movable shade 22 is pivoted forward around the pivotal axis A up to the position where the stay 22B butts against the lower end face of the displacement regulating block 32 as the movable iron core 36 is moved backward and fixed to the high-beam position shown in FIG. 2(*b*).

When the movable shade 22 is pivoted to the low- or high-beam position, the edge face 22*b* of its stay 22B butts against the base of the V-shaped groove. However, because the lateral displacement of the stay 22B is regulated by both side wall surfaces of the V-shaped groove, the deviation of the movable shade 22 in the longitudinal or lateral direction is prevented thereby. Further, the displacement regulating spring 46 fitted to the front end portion of the projected portion 26*b* of the bulb supporting base 26 is so formed as to extend substantially in U-shape along the underside of the projected portion 26*b*. When the movable shade 22 is pivoted to the high-beam position, it is elastically deformed by butting against the edge face 22*b* of the stay 22B. The backlash of the coupling portion between the stay 22B and the shaft member 42, that of the coupling portion between the stay 22B and the movable iron core 36 of the solenoid 34 and that of movable iron core 36 itself can be absorbed. Thus, the undesirable knocking sound is muted when beams are switched.

The fixed shade 28 for covering the movable shade 22 is provided substantially in front of the movable shade 22. The fixed shade 28 is formed integrally with a cap-like shade body 28A in the form of a vertically-long ellipse and a sectionally U-shaped stay 28B extending from the lower end portion of the shade body 28A downward close to the rear side. Further, the fixed shade 28 is fixed to the reflector 20 with the screw in the lower end portion of the stay 28B. A shade fixing seat portion 20*d* is projected from the lower end portion of the reflective surface 20*a* in the reflector 20.

As set forth above in detail, the vehicle headlamp 10 according to the invention is equipped with the shade driving unit 22 for pivoting the movable shade 22 between at least two positions where the incident light is shaded differently. The movable shade 22 is capable of shading part of light incident on the reflective surface 20*a* of the reflector 20 from the discharge light emitting portion 18*a* of the discharge bulb 18. The discharge bulb 18 is fixedly supported by the reflector 20 via the bulb supporting base 26 with movable shade 22 and the shade driving unit 24 that are fitted to the bulb supporting base 26. Thus, the light source bulb 18, the movable shade 22 and the shade driving unit 24 together with the bulb supporting base 26 can function integrally as a unit.

Therefore, the lamp can easily be assembled by prefabricating the unit and then fitting the unit to the reflector 20. Moreover, the precision of placement of the movable shade 22 with respect to the discharge light emitting portion 18*a* is improved.

According to this embodiment of the invention, if the bulb supporting base 26 is formed by die casting, which imparts excellent dimensional precision and strength, the precision of placement of the movable shade 22 with respect to the discharge light emitting portion 18 can be improved further.

According to this embodiment of the invention, further, the fixed shade 28 for covering the movable shade 22 of the movable shade 22 substantially in front of the movable shade 22 makes it difficult for the movable shade 22 and its peripheral structure (i.e., the structure of supporting the movable shade 22 with the bulb supporting base 26, the structure of coupling the movable shade 22 to the movable iron core 36 of the solenoid 34) to be seen from the outside.

Another embodiment of the invention will subsequently be described.

Figure 4:
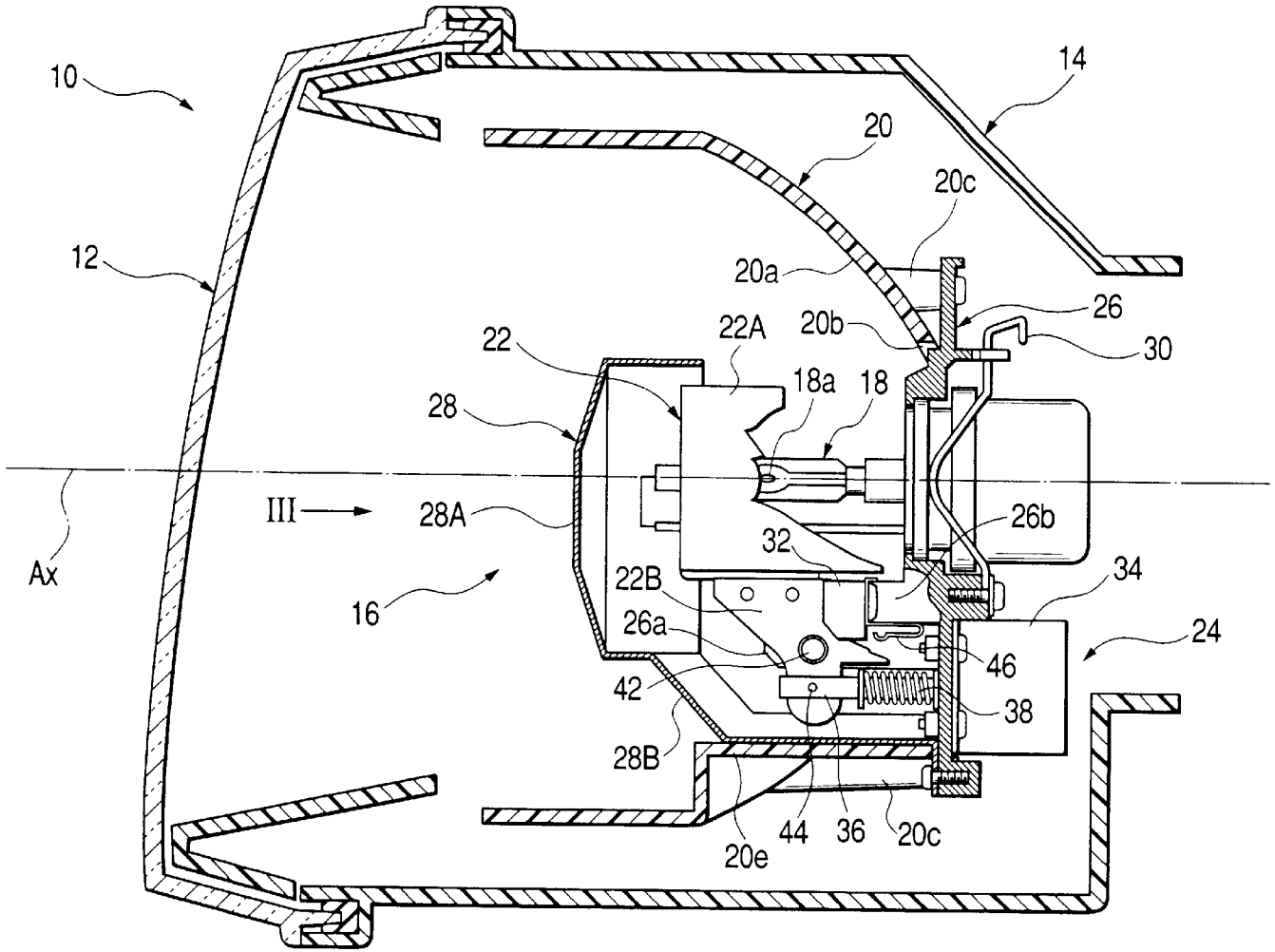
FIG. 4 is a sectional side view of another embodiment of the invention.

FIG. 4 shows another embodiment of the invention similar to one shown in FIG. 1.

As shown in FIG. 4, according to the embodiment of the invention, the fixed shade 28 is fixed not to the reflector 20 but fixed to the lower end portion of the bulb supporting base 26 with a screw. In this arrangement, the stay 28B of the fixed shade 28 is extended backward. Further, a fluted portion 20*e* is formed in the lower end portion of the reflector 20, so that the stay 28B is supported by the fluted portion 20*e* from below.

The fixed shade 28 is provided by fixedly supporting the fixed shade 28 by the bulb supporting base 26 in this embodiment of the invention. The efficiency of lamp assembly can be thus improved.

Figure 5:
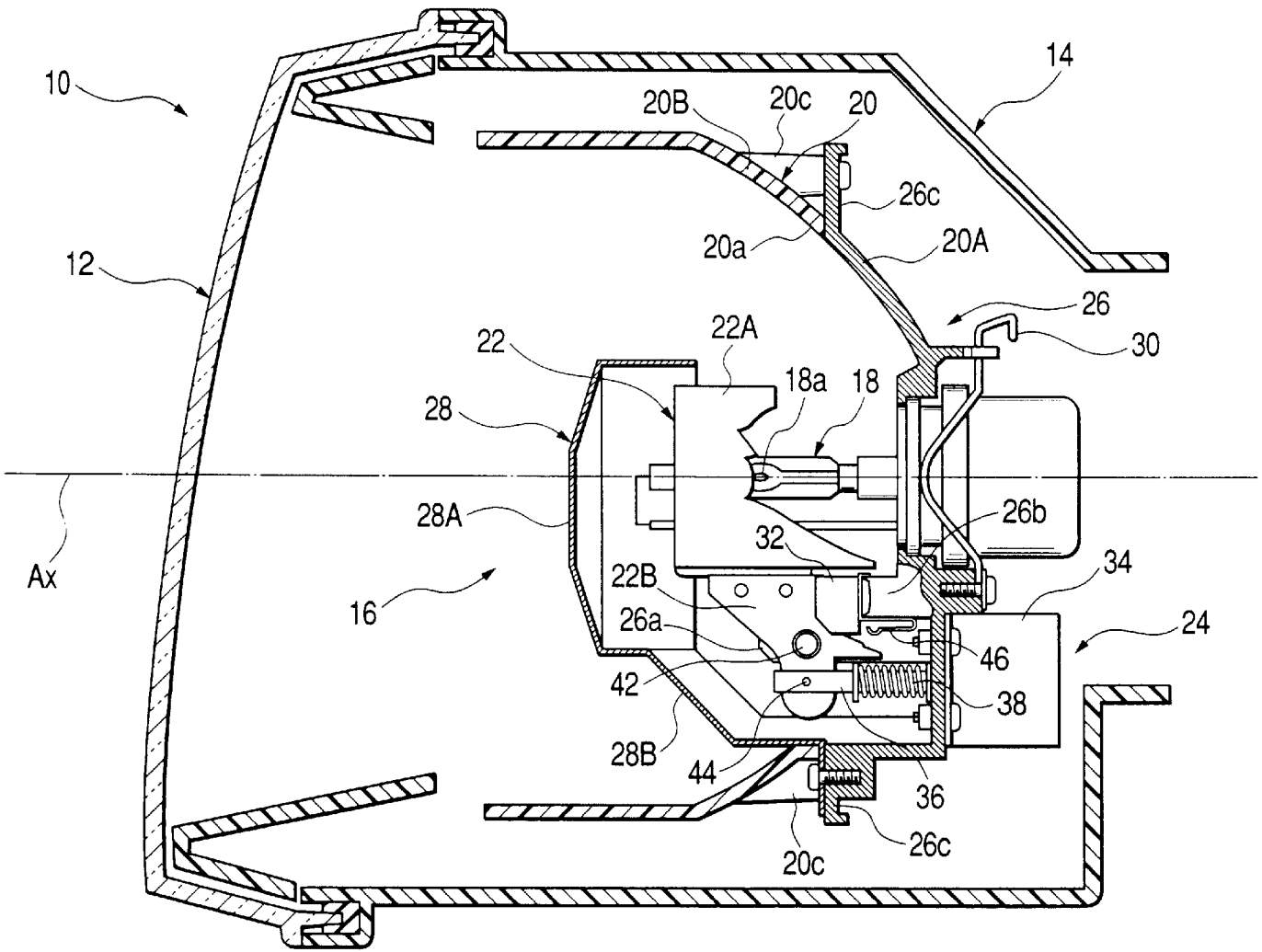
FIG. 5 is a sectional side view of still another embodiment of the invention.

FIG. 5 shows still another embodiment of the invention similar to one shown in FIG. 1.

As shown in FIG. 5, according to the embodiment of the invention, the central portion 20A (part) of the reflector 20 close to the optical axis Ax is separated from the peripheral portion 20B (remaining part) of the reflector 20. The central portion 20A of the reflector 20 is formed integrally with the bulb supporting base 26. The bulb supporting base 26 is fixed to the plurality of bosses 20*c* with screws on the back of the peripheral portion 20B of the reflector 20. In this embodiment of the invention, the fixed shade 28 is fixed to the lower end portion of the bulb supporting base 26 with a screw.

The central portion 20A of the reflector 20 is separated from its peripheral portion 20B before being formed integrally with the bulb supporting base 26. Then, the bulb supporting base 26 can fixedly be supported by utilizing a wide area of the reflector 20. Thus, the precision of placement of the optical system of the lamp can be increased. The fixed shade 28 is fixedly supported by the bulb supporting base 26 also in this embodiment of the invention to provide the movable shade 28. Thus, the efficiency of lamp assembly can be improved.

The present invention claims priority from Japanese patent application serial no. H11-297483, which is incorporated herein by this reference in its entirety.

Several embodiments of the invention have been described herein, but it should be understood that various additions and modifications could be made which fall within the scope of the following claims.

What is claimed is:

1. A vehicle headlamp comprising:

a light source with a light source bulb;

a reflector for reflecting light from said light source forward;

a movable shade capable of shading part of light incident on said reflector from the light source;

a shade driving unit for moving the movable shade between at least two positions where the incident light is shaded in different degrees;

a bulb supporting base for supporting said light source bulb, said movable shade, and said shade driving unit; and said bulb supporting base fixedly supported by said reflector; and a fixed shade for covering said movable shade provided substantially in front of said movable shade such that the movable shade is substantially disposed between the fixed shade and the light source, and said fixed shade fixedly supported by said bulb supporting base.

2. The vehicle headlamp as claimed in claim 1, wherein said bulb supporting base is formed by die casting.

3. A vehicle headlamp as claimed in claim 1, wherein said reflector is formed so that part of said reflector is separated from the remaining portion of said reflector, wherein part of said reflector is formed integrally with said bulb supporting base.

4. A vehicle headlamp comprising:

a light source with a light source bulb;

a reflector for reflecting light from said light source forward;

a movable shade capable of shading part of light incident on said reflector from the light source;

a shade driving unit for moving the movable shade between at least two positions where the incident light is shaded in different degrees;

a bulb supporting base for supporting said light source bulb, said movable shade, and said shade driving unit; and said bulb supporting base fixedly supported by said reflector; and a fixed shade for covering said movable shade provided substantially in front of said movable shade such that the movable shade is substantially disposed between the fixed shade and the light source, and said fixed shade fixedly supported by said reflector.

5. A vehicle headlamp comprising:

a light source with a light source bulb;

a reflector substantially behind said light source for reflecting light from said light source forward;

a movable shade substantially in front of said light source for shading part of light incident on said reflector from the light source;

a shade driving unit for moving the movable shade between at least two positions where the incident light is shaded in different degrees;

a bulb supporting base for supporting said light source bulb, said movable shade, and said shade driving unit as an integral unit; said movable shade pivotally attached to said driving unit; and said bulb supporting base fixedly supported by said reflector; and a fixed shade for covering said movable shade provided substantially in front of said movable shade such that the movable shade is substantially disposed between the fixed shade and the light source, and said fixed shade fixedly supported by said reflector.

6. The vehicle headlamp as claimed in claim 5, wherein said bulb supporting base is formed by die casting.

7. A vehicle headlamp comprising;

a light source with a light source bulb;

a reflector substantially behind said light source for reflecting light from said light source forward;

a movable shade substantially in front of said light source for shading part of light incident on said reflector from the light source;

a shade driving unit for moving the movable shade between at least two positions where the incident light is shaded in different degrees;

a bulb supporting base for supporting said light source bulb, said movable shade, and said shade driving unit as an integral unit; said movable shade pivotally attached to said driving unit; and said bulb supporting base fixedly supported by said reflector; and a fixed shade for covering said movable shade provided substantially in front of said movable shade such that the movable shade is substantially disposed between the fixed shade and the light source, and said fixed shade fixedly supported by said bulb supporting base.

8. The vehicle headlamp as claimed in claim 5, wherein said reflector comprises two separate parts, wherein one part of said reflector is formed integrally with said bulb supporting base.

9. The vehicle headlamp as claimed in claim 1, wherein said movable shade is pivotally supported by a part of said bulb supporting base and pivotally attached to said shade driving unit.

10. The vehicle headlamp as claimed in claim 5, wherein said movable shade is pivotally supported by a part of said bulb supporting base.

11. The vehicle headlamp as claimed in claim 1, wherein said shade driving unit comprises a solenoid, a movable iron core actuated by said solenoid, and a return spring fitted to said movable iron core, said return spring urging the movable iron core toward an unexcited position of the solenoid.

12. The vehicle headlamp as claimed in claim 5, wherein said shade driving unit comprises a solenoid, a movable iron core actuated by said solenoid, and a return spring fitted to said movable iron core, said return spring urging the movable iron core toward an unexcited position of the solenoid.

13. The vehicle headlamp as claimed in claim 4, wherein said bulb supporting base is formed by die casting.

14. A vehicle headlamp as claimed in claim 4, wherein said reflector is formed so that part of said reflector is separated from the remaining portion of said reflector, wherein part of said reflector is formed integrally with said bulb supporting base.

15. The vehicle headlamp as claimed in claim 4, wherein said movable shade is pivotally supported by a part of said bulb supporting base and is pivotally attached to said shade driving unit.

16. The vehicle headlamp as claimed in claim 4, wherein said shade driving unit comprises a solenoid, a movable iron core actuated by said solenoid, and a return spring fitted to said movable iron core, said return spring urging the movable iron core toward and unexcited position of the solenoid.

17. The vehicle headlamp as claimed in claim 7, wherein said bulb supporting base is formed by die casting.

18. The vehicle headlamp as claimed in claim 7, wherein said reflector comprises two separated parts, wherein one part of said reflector is formed integrally with said bulb supporting base.

19. The vehicle headlamp as claimed in claim 7, wherein said movable shade is pivotally supported by a part of said bulb supporting base.

20. The vehicle headlamp as claimed in claim 7, wherein said shade driving unit comprised a solenoid, a movable iron core actuated by said solenoid, and a return spring fitted to said movable iron core, said return spring urging the movable iron core toward and unexcited position of the solenoid.

* * * * *